United States Patent [19]

Smith et al.

[11] Patent Number: 4,481,395

[45] Date of Patent: Nov. 6, 1984

[54] RESTRICTIVE INSERT FOR MICROWAVE OVENS

[76] Inventors: Charles M. Smith, 160 E. Brandy La., Merritt Island, Fla. 32952; Robert W. Penn, 2805 Kenyon Ave., Cocoa, Fla. 32922; George W. Pangborn, 4310 Beacon Ct., Titusville, Fla. 32780

[21] Appl. No.: 416,982

[22] Filed: Sep. 13, 1982

[51] Int. Cl.[3] ..... H05B 9/06

[52] U.S. Cl. ..... 219/10.55 E; 219/10.55 R

[58] Field of Search ..... 219/10.55 E, 10.55 F, 219/10.55 R, 10.55 A

[56] References Cited

U.S. PATENT DOCUMENTS

| | | | |
|---|---|---|---|
| 3,410,116 | 11/1968 | Levinson | 219/10.55 E |
| 4,108,147 | 8/1978 | Kantor | 219/10.55 A |
| 4,249,464 | 2/1981 | Hansen | 219/10.55 E |
| 4,283,427 | 8/1981 | Winters et al. | 219/10.55 E |

*Primary Examiner*—Roy N. Envall, Jr.
*Assistant Examiner*—M. M. Lateef
*Attorney, Agent, or Firm*—Duckworth, Allen, Dyer & Pettis

[57] ABSTRACT

A restrictive insert for a microwave oven cavity is disclosed including a front plate having a substantially rectangular opening thereon and a horizontally disposed platform attached to the front plate and extending into the microwave oven cavity thereby restricting access to the interior of the cavity to objects of a predetermined cross sectional area.

9 Claims, 3 Drawing Figures

RESTRICTIVE INSERT FOR MICROWAVE OVENS

BACKGROUND OF THE INVENTION

This invention relates in general to equipment used in conjunction with a microwave cavity, and more particularly to a restrictive insert for microwave cavities which are used in conjunction with food vending machines.

Since the development of the microwave ovens, a number of devices have been developed to aid in the heating of foods of various dimensions. For example, U.S. Pat. No. 3,091,172 (Wildemann), illustrates an apparatus in which it is possible to heat uniformly sausages or similarly elongated objects of different sizes and having different types of envelopes within the desired short time of about 15 seconds. In U.S. Pat. No. 3,283,113 (Smith), a small microwave oven suitable for use in vending machines for quickly cooking individual tubular units of the size and shape of frankfurter in a bun is disclosed. U.S. Pat. No. 2,733,650 (Williams) illustrates a microwave cooker to be incorporated in a vending machine. U.S. Pat. No. 2,820,127 (Argento) illustrates a microwave cavity having a plurality of slots on the side of the cavity and dimensions such that when the cavity is unloaded waste will be propagated in a particular mode which will cooperate with the slots, to pass energy out of the cavity through the slots, thus preventing its reflecting back into the cavity. U.S. Pat. No. 3,210,511 (Smith), describes an oven of small size suitable for heating single articles of food very quickly. U.S. Pat. No. 3,440,383 (Smith) discloses the use of a microwave device for heating food articles which includes a microwave source and a wave guide connected to the source with a normally open end adjacent to the food article. The food articles are contained in individual disposable containers including a conductive sheet surrounding all but one side of the container, the latter being permeable to the microwave energy. The containers are positioned with the permeable side adjacent to the open end of the waveguard, to extend the waveguide and enclose it around the food article, which serves as a load for the microwave energy. U.S. Pat. No. 3,665,491 (Cooper) illustrates a microwave oven divided into a plurality of zones. Each zone is operative to generate a different quantity of heat energy. Food trays are provided divided into a plurality of compartments, each adapted to be aligned with one of the oven zones so that the good disposed in that tray compartment is heated to the desired temperature. The primary disadvantage of these devices is that it requires the manufacture of a special type of oven and special types of vending dispensers, thus adding to the cost and complexity to the vending machine purveyors who desire to provide microwave heating service. Indeed, none of the devices referred to above have come into wide scale use in the United States in association with the purveying of foods from vending machines. Rather, the purveyors of food from vending machines use conventional microwave ovens, such as those used by a housewife, which has a relatively large cavity. The primary problem with the use of such an oven for the heating of sandwiches, etc., in a vending machine operation, is that there is no way of restricting access to the oven to only those people that have purchased food from the vending machine. Thus, it is not unusual to see persons that have purchased their sandwich from a vending machine waiting for a long period of time while some individual heats a casserole brought from his home. In addition to the inconvenience to the customer of the vending machine, the use of the microwave oven by people bringing foods from their homes tends to overload the machine since it is in use for longer periods of time.

Numerous accessories have been devised for use in microwave ovens. For example, U.S. Pat. No. 2,912,554 (Synder), illustrates the use of a metal sheel for electronic ovens constructed so that it does not absorb any appreciable quantity of the high frequency energy supplied to the oven. U.S. Pat. No. 2,997,566 (Pierce), shows a combination of deep fat fryer and microwave oven for cooking foodstuffs. U.S. Pat. No. 4,272,663 (Green) describes an apparatus for cooking steaks including a number of posts and two plates which are disposed in a sandwich configuration around a steak. The device is used to cook the steaks to the desired doneness. Also, U.S. Pat. No. 4,249,464 (Hansen), illustrates a rack to be placed in a microwave oven having a grid frame with open space allowing the dissipation of moisture. None of the devices described above are designed to deal with "problem of" unauthorized use of microwave ovens by noncustomers of vending machine operators.

Another patent of interest is U.S. Pat. No. 4,159,769 (Hatten) which illustrates a vending machine adaptor to allow items not normally suited to be vended through a particular vending machine to be vended. Hatten does not disclose any compatability with microwave ovens, nor is the design to restrict the accessibility of a microwave oven.

SUMMARY OF THE INVENTION

The restrictive insert for microwave ovens of the present invention is characterized by a front plate having an opening thereon and adapted to cover the front space behind the door of a microwave oven. The insert is provided with a substantially horizontal member juxtaposed to the lower edge of the opening. The insert is attached to the side walls of the microwave oven.

BRIEF DESCRIPTION OF THE DRAWINGS

Further details are explained below with the help of the examples illustrated in the attached drawings in which.

DESCRIPTION OF THE INVENTION

Figure 1:
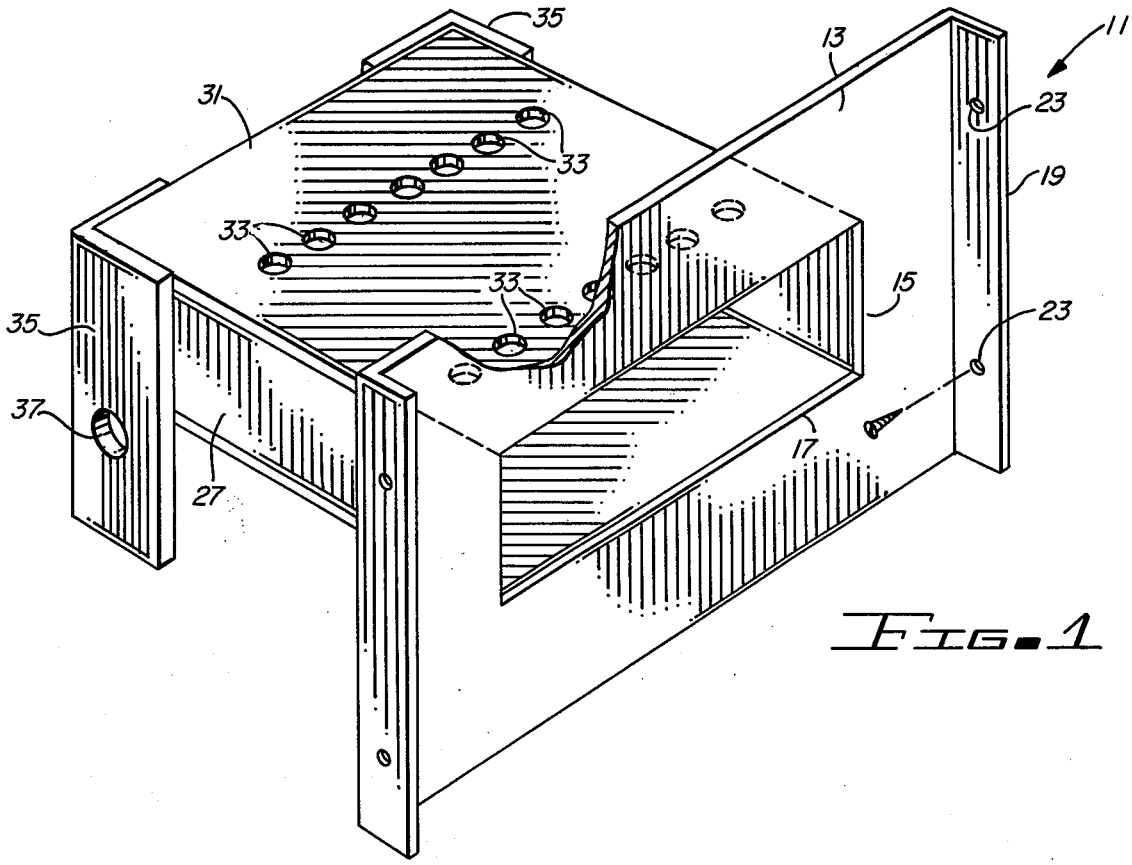
FIG. 1 is an overall view of the restrictive insert for microwave ovens according to the present invention.

Illustrated in FIG. 1 is a restrictive insert 11 in accordance with the present invention. The insert 11 includes a front plate 13 having a rectangular opening 15 substantially centered on the front plate 13. While the rectangular opening 15 is preferred, it should be noted that the shape of the opening is not critical to the operation of the restrictive insert 13. The opening 15 should have at least one bottom portion 17 which is substantially flat. The restrictive insert 11 may be provided with a flange portion 19 around its periphery. The flange portion 19 is dimensioned so that the external dimension of the flange portion 19 are substantially equal to the internal dimensions of the microwave cavity 21 (shown in FIG. 2).

The flange portion 19 is provided with a plurality of holes 23 through which screws 25 of the type having a stripped head that can only be inserted and not removed. The screws 25 as well as the front plate 13 and the flange portion 19 should be made of material that does not reflect or absorb microwave energy and that can withstand temperatures up to 250 degrees. Such materials could be acrylic, plexiglass or PVC.

The restrictive insert 11 also includes a horizontal member 27 which is attached to the front plate 13 at the bottom portion 17 of the rectangular opening 15. The horizontal member 27 provides a platform for the support of the food materials which are to be heated by the microwave oven 29 (shown in FIG. 2) utilizing the restrictive insert 11. The restrictive insert 11 may also be provided with a top horizontal member 31 which is attached to the front plate 13 at the upper portion of the rectangular opening 15. If a top horizontal member 31 is used, it should be provided with a plurality of venting openings 33 which would allow for the venting of steam into the microwave cavity 21 so that the foods being heated are not adversely affected. The restrictive insert 11 may also be provided with a pair of rear support legs 35 which can be attached to the horizontal member 27 and to the top horizontal member 31 if any is used. The rear support legs 35 may be provided with openings 37 to enable further attachment to the interior surface of the microwave cavity 21.

Figure 2:
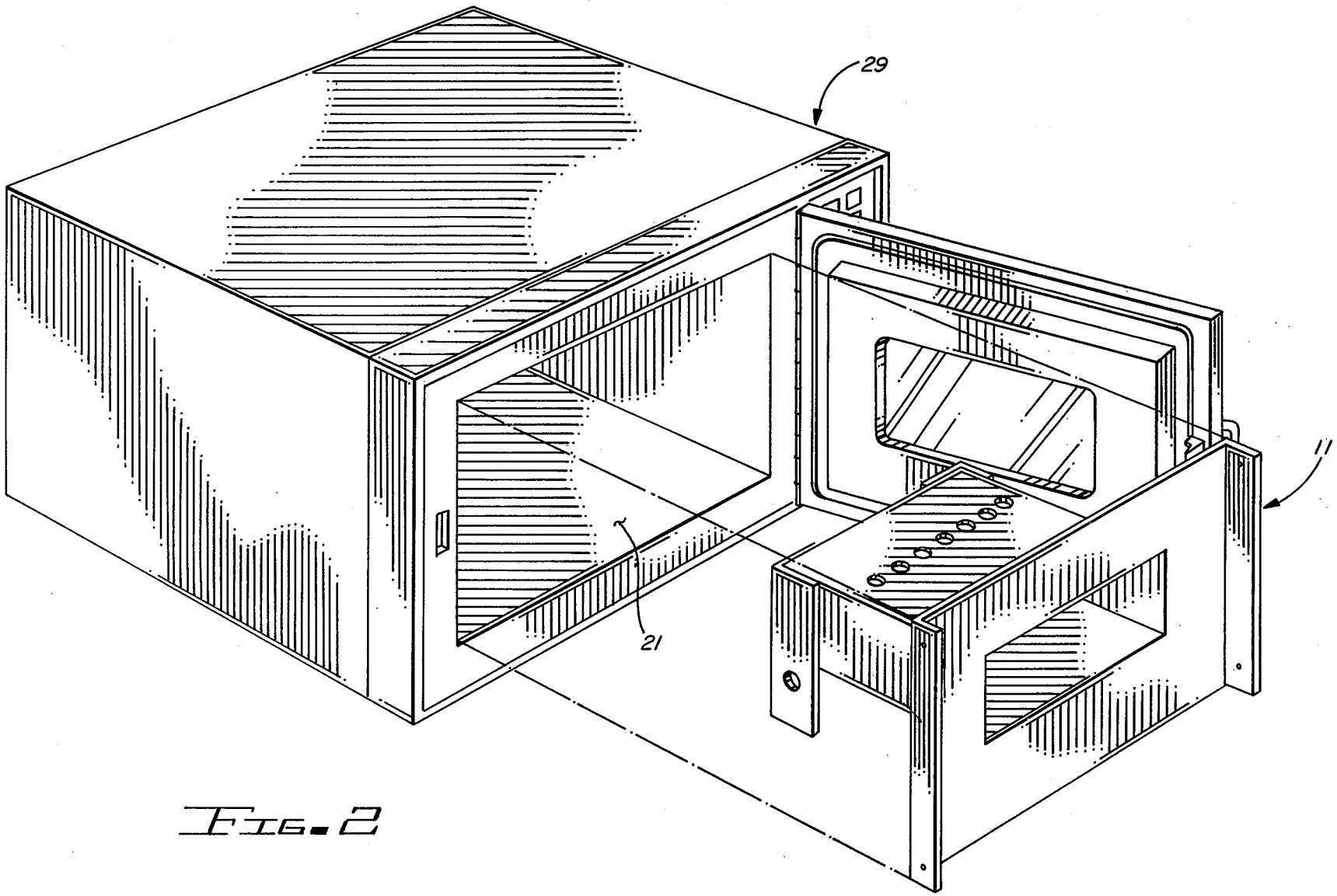
FIG. 2 is an illustration of a microwave oven and a restrictive insert to be attached thereto.

As illustrated in FIG. 2 the restrictive insert 11 is adapted to fit into the microwave cavity 21 defined by microwave oven 29. The restrictive insert 11 limits the useable internal volume of the microwave cavity 21 to the volume defined by the area of the rectangular opening 15 and the depth of the horizontal member 27. As can be appreciated the area of the rectangular opening 15 can be varied depending on the food items that are to be heated in the microwave oven. Normally, the rectangular opening 15 would be made large enough so that all sandwiches or small trays dispensed by vending machine can be inserted and removed without undue manipulation. The front plate 13 of the restrictive insert 11 serves as a means for blocking the access of the rest of the microwave cavity 21 so that person desiring to heat objects larger than those dispensed by the vending machines cannot have access to the microwave oven. The result is a savings in the maintenance required to be performed on the microwave ovens 29 as well as added convenience to the customer of the vending machines.

It sould be stressed that all the materials used in the restrictive insert 11, as well as the materials used to attach the restrictive insert 11 to the surface of the microwave cavity 21 should be made of material that does not reflect or absorb microwave energy and can withstand temperatures of up to 250 degrees Fahrenheit. As mentioned above, ¼" acrylic, plexiglass, or PVC can be used for this purpose. Additionally, it would be most advantageous if the insert 11 were integrally formed rather than made in pieces. Thus, a mold can be made so that the restrictive insert 11 can be blow molded or injection molded as a single integral piece.

Figure 3:
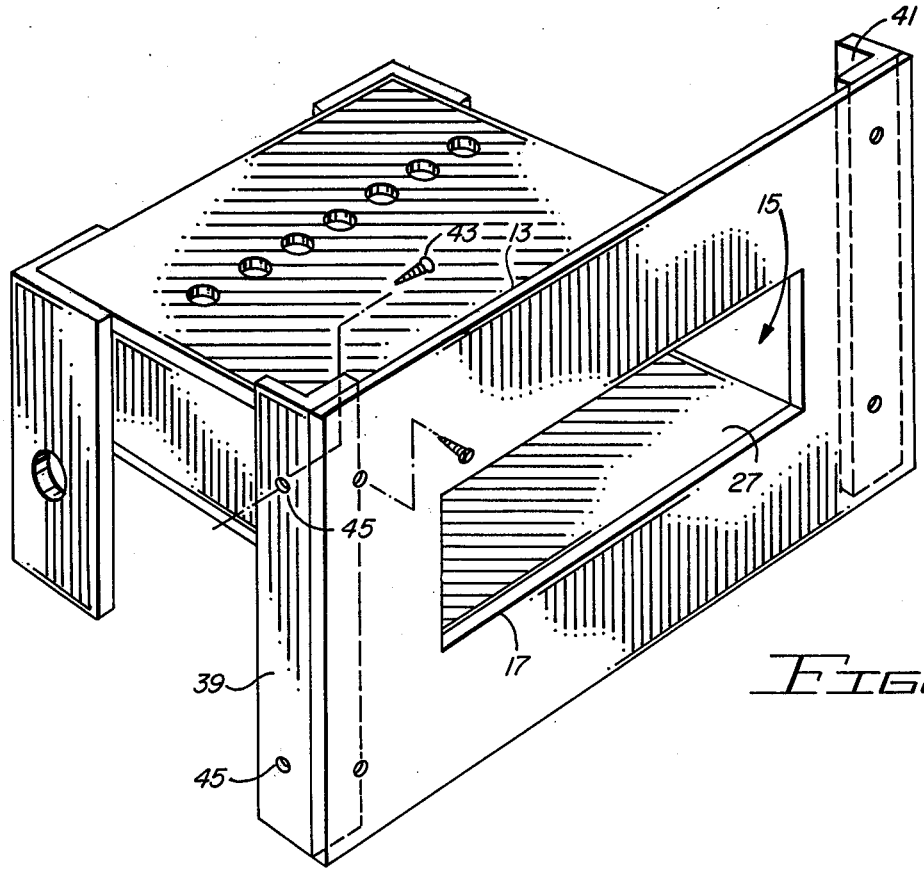
FIG. 3 is an alternate embodiment of the restrictive insert.

Illustrated in FIG. 3 is an alternate embodiment of the present invention. In the embodiment of FIG. 3 a pair of angle members 39 and 41 are disposed in the interior portion of the microwave cavity and are attached by means of screws 43 to the inside wall of the microwave cavity. The angle members 39 and 41 are suitably provided with a plurality of holes 45 which can be used to guide the screws 43 for attachment of the side wall of the microwave cavity. It should be stressed that the screw 43 should be made of material that is not reflective or absorptive of microwave energy. Similarly, the angle members 39 and 41 should be made of the material previously specified for example, plexiglass or PVC. In this embodiment the front plate 13 is attached to the angle member 39 by means of tamper proof screws. The advantage of the embodiment of FIG. 3 is that it does not reduce the depth of the microwave oven cavity that is available for cooking. Additionally, the embodiment illustrated in FIG. 3 is easy to attach to a conventional microwave oven. It should be noted that while the insert 13 may be integrally molded, and the embodiment of FIG. 3 the angle members 39 and 41 cannot be molded integrally with the insert 11 as it would be impossible then to attach the angle members 39 and 41 to the sidewalls of the cavity. Another advantage of the embodiment of FIG. 3 is that it can be used to make the removal of the front plate 13 more difficult. After the angle members 39 and 41 are installed, the front plate 13 can be attached by using nylon rivets, canoe clips, tamper proof screws or other suitable devices. This would make it more difficult for unauthorized persons to remove the insert from the microwave. Another advantage is that the angle members 39 and 41 need not be of the same size as the front plate 13. Thus, a standardized set of angle members can be used for all the different sizes of microwave cavities. The front plate may be made large enough to fit the largest microwave cavity and may be cut to size on installation.

It will thus be seen that the objects set forth above, among those made apparent from the preceeding description and drawings are efficiently attained, and, since certain changes may be made in the above articles without departing from the scope of the invention, it is intended that all matter contained in the above description (or shown in the accompanying drawings) shall be interpreted as illustrative and not in a limiting sense.

I claim:

1. A restrictive insert for a microwave oven cavity comprising:

a front plate having a substantially rectangular opening therein;

a horizontally disposed platform attached to the front plate and extending into the microwave cavity whereby only items having a cross-sectional contour smaller than the contour of the rectangular opening can be heated in the microwave oven;

a first vertically disposed leg attached to one corner of the platform;

a second vertically disposed leg attached to the other corner of the platform; and means for attaching the front plate to the microwave oven cavity;

whereby said platform is within the microwave radiation field in the central portion of said microwave oven cavity.

2. A restrictive insert of claim 1 further comprising:

a horizontally disposed top attached to the front plate and extending into the microwave cavity said top having a plurality of openings therethrough whereby venting can be achieved.

3. The restrictive insert of claim 1 wherein said front plate, and platform are made of material that does not reflect or absorb microwave energy.

4. The restrictive insert of claim 3 wherein said material can withstand temperatures up to 250 degrees Farenheit.

5. In a microwave oven having a cavity with four walls, and a door the improvement comprising:

a front plate disposed in said cavity, said front plate having an opening of predetermined size thereon;

a horizontal platform attached to said front plate and disposed in the cavity substantially perpendicular with the lower portion of said opening;

a flange attached substantially perpendicular to the front plate, said flange having a plurality of holes;

a plurality of screws disposed through said holes and into the walls of the microwave oven, said screws and flange attaching the front plate to at least one wall of the microwave oven, whereby the volume of material to be heated by the microwave oven can be restricted to material of a size capable of being inserted through the opening;

a substantially horizontal top disposed substantially perpendicular to the front plate and attached to the front plate adjacent to the upper surface of the opening;

a first leg disposed in said cavity and attached to the platform and the top; and a second leg disposed in said cavity and attached to the platform and the top.

6. The improvement of claim 5 wherein said screws have a partially stripped head whereby it is not possible to unscrew the screws.

7. The improvement of claim 6 wherein said screws are made of a material that does not substantially absorb or reflect microwave energy.

8. The improvement of claim 5 wherein said front plate, horizontal platform and means for attaching are made of a material which does not substantially absorb or reflect microwave energy.

9. The improvement of claim 5 wherein said opening is substantially centered on the front plate.

* * * * *